United States Patent [19]

Rampe

[11] 4,103,146

[45] Jul. 25, 1978

[54] METHODS AND APPARATUS FOR DUCTLESSLY CIRCULATING AND SELECTIVELY SUPPLEMENTALLY HEATING LARGE VOLUMES OF AIR IN INDUSTRIAL FACILITIES

[75] Inventor: John F. Rampe, Mayfield Heights, Ohio

[73] Assignee: Rampe Research, Cleveland, Ohio

[21] Appl. No.: 649,983

[22] Filed: Jan. 19, 1976

Related U.S. Application Data

[63] Continuation-in-part of Ser. No. 609,142, Sep. 2, 1975, abandoned.

[51] Int. Cl.[2] ..... F24H 3/02; H05B 1/00

[52] U.S. Cl. ..... 219/368; 165/76; 165/122; 219/367; 219/370; 219/375; 417/424

[58] Field of Search ..... 219/359, 360, 361, 366, 219/367, 368, 369, 370, 374, 375, 376; 62/427, 419; 98/45, 33 A, 114; 237/50, 52, 47; 165/58, 59, 121, 122, 124, 125, 126, 76; 126/99 A, 110 R, 110 A, 109, 114; 415/219 R, 219 C; 417/424, 423 R

[56] References Cited

U.S. PATENT DOCUMENTS

| | | | |
|---|---|---|---|
| 1,620,767 | 3/1926 | Johnson | 219/370 |
| 1,708,580 | 4/1927 | Kerladuezo | 219/367 |
| 1,716,791 | 6/1929 | Ness | 219/370 |
| 2,003,496 | 6/1935 | Roe | 219/367 |
| 2,299,939 | 10/1942 | Swanson | 165/122 |
| 2,405,783 | 8/1946 | Gardenhour | 219/367 |
| 2,431,724 | 12/1947 | Aydt | 417/424 |
| 2,615,383 | 10/1952 | Jenn | 98/33 A |
| 2,630,267 | 3/1953 | Ostrognai | 417/424 |
| 2,712,053 | 6/1955 | Gallay | 219/366 |
| 2,875,316 | 2/1959 | Ford et al. | 219/368 |
| 3,098,145 | 7/1963 | Raymond | 219/374 |
| 3,102,185 | 8/1963 | Boyd | 219/374 |

FOREIGN PATENT DOCUMENTS

| | | | |
|---|---|---|---|
| 647,062 | 8/1962 | Canada | 165/76 |
| 929,954 | 1/1948 | France | 219/368 |
| 881,249 | 5/1943 | France | 219/374 |
| 205,466 | 10/1939 | Switzerland | 219/367 |

*Primary Examiner*—J. V. Truhe
*Assistant Examiner*—Bernard Roskoski
*Attorney, Agent, or Firm*—David A. Burge

[57] ABSTRACT

An apparatus for ductlessly circulating large volumes of air in industrial facilities and the like includes an upstanding structure which defines a vertically extending chamber. Openings are provided in lower and upper portions of the structure and communicate the chamber with lower and upper strata of ambient air. A blower assembly is housed within the structure intermediate the lower and upper openings. In operation, the apparatus is positioned substantially centrally in a room, and the blower assembly is energized to move air upwardly through the chamber. The lower and upper openings are arranged such that air from the lower strata is drawn substantially radially toward the lower openings, and such that air discharging from the upper openings into the upper strata moves substantially radially outwardly toward walls of the room. The effect of this type of operation is to establish a primary substantially toroidal air flow circulation beside the apparatus, and to induce the establishment of a secondary substantially toroidal air flow circulation above the apparatus. The primary and secondary circulation torri promote a thorough intermixing of air from all parts of the room and promote temperature uniformity throughout the room. In the preferred embodiment, the apparatus is portable and its upstanding structure is provided by a stacked array of lower, intermediate and upper modules or sections. A heater assembly for selectively supplementally heating air in the chamber is preferably housed in an intermediate one of the modules or sections.

3 Claims, 5 Drawing Figures

METHODS AND APPARATUS FOR DUCTLESSLY CIRCULATING AND SELECTIVELY SUPPLEMENTALLY HEATING LARGE VOLUMES OF AIR IN INDUSTRIAL FACILITIES

CROSS REFERENCE TO RELATED APPLICATION

The present application is a continuation-in-part of application Ser. No. 609,142 filed Sept. 2, 1975, now abandoned, the disclosure of which is incorporated by reference.

BACKGROUND OF THE INVENTION

1. Field of the Invention

The present invention relates to methods and apparatus for circulating and selectively supplementally heating large volumes of air in industrial facilities and the like.

2. Prior Art

Industrial facilities including warehousing, fabrication, machining and assembly areas typically have relatively high ceilings to accommodate the operation of hoists, lift trucks, overhead conveyors, and other industrial equipment. Heated air rises and accummulates near high ceilings. While a heating system is laboring to maintain 65° F. at body level in a high-ceilinged room, ceiling temperature may reach 88° F. or above. Most heating systems do little to return ceiling air into body level circulation, and as such, the high temperature ceiling air represents a substantial loss of energy.

Proposals have been made to heat warehouses and other large industrial buildings with ductless furnaces positioned along walls or near corners of the building. One furnace proposed for such use has a modular construction including a lower intake section, an intermediate heater section, and an upper discharge section. One drawback of the proposed furnace is that its being positioned near walls or in a corner of the room it serves inhibits its drawing ceiling air efficiently into circulation. An other drawback is that its air inlet and discharge openings are not provided around the entire periphery of the inlet and discharge sections to permit an efficient, radially directed intake and discharge of air. The non-radially directed intake and discharge flow paths that result due both to the configuration of the intake and discharge sections and due to the positioning of the proposed furnace along a wall or in a corner, provide inefficient air circulations that often do not reach all portions of the room being heated and are readily disturbed by obstructions as columns, low partitions, and nearby machinery.

A problem commonly encountered in industrial facilities is that activities conducted in different areas are subject to change from time to time, as demand increases and decreases for certain types of products and services. While activities conducted in an area of an industrial facility may change relatively substantially, it is unusual for accommodating changes to be made in the area's heating system. Heating systems are ordinarily permanently installed and, while their output can be controlled within a range to provide some accommodation for a change in heat demand, such systems seldom include provisions to enhance air circulation in and provide supplemental comfort heating for a specific area where activities are temporarily concentrated.

Portable heaters of various types have been proposed to supplement the operation of existing heating systems.

A drawback of such proposals is their inability to gently and effectively circulate large volumes of air in a designated area. Proposed portable heaters are expensive to operate and tend to provide an uncomfortable working atmosphere with hot air concentrated near the heaters and with a substantially colder air environment only a few feet away. Where proposed portable heaters have relatively large air circulating capabilities, they have typically been noisy in operation and provide directional high velocity heated air outputs that are objectionable. Moreover, proposed portable heaters do practically nothing to bring high temperature ceiling air back into circulation.

SUMMARY OF THE INVENTION

The present invention overcomes the foregoing and other drawbacks of the prior art by providing methods and apparatus for efficiently, ductlessly, circulating and selectively supplementally heating large volumes of air in industrial facilities and the like.

An air circulating apparatus includes an upstanding structure which defines a vertically extending chamber. Openings are provided in lower and upper portions of the structure and communicate the chamber with lower and upper ambient air strata. A blower assembly is housed within the structure intermediate the lower and upper openings. The lower and upper openings are arranged such that, when the blower assembly is operated to move air upwardly in the chamber, air from the lower strata is drawn substantially radially toward the lower openings, and air discharging from the upper openings into the upper strata moves substantially radially outwardly toward walls of the room.

The lower openings preferably extend around the entire periphery of the lower end region of the upstanding structure from floor-level to a height about 2 to 3 feet above floor level. The upper openings preferably extend around the entire periphery of the upper end region of the upstanding structure in a 2 to 3 foot wide band located about 6 to 10 feet above floor level. This arrangement of openings promotes the movement of a 2 to 3 foot thick blanket of lower strata air radially inwardly toward the lower openings, and the movement of a 2 to 3 foot thick blanket of upper strata air radially outwardly from the upper openings. The moving blanket of upper strata air descends as it approaches the walls of the room to replace air moving radially inwardly in the lower strata air blanket. The result is a rolling doughnut-shaped or torroidal "primary" air flow circulation.

The "primary" circulation torus operates to induce a "secondary" air flow circulation in the space above the apparatus. A secondary flow is induced by virtue of the fact that flowing air has a lesser pressure than static air. The principle that pressure of a flowing fluid diminishes as flow velocity increases is known to those skilled in the art as Bernoulli's Theorem.

As air discharges at a relatively fast velocity from the upper openings it has a noticeably reduced pressure. The reduced pressure profile of air which discharges from the apparatus and which forms the upper strata air blanket causes overhead air to be drawn downwardly toward the "primary" circulation torus and to travel radially outwardly with upper strata air in the "primary" torus. The result is the induced establishment of an overhead, "secondary" air circulation flow that is of substantially toroidal shape. The "primary" and "secondary" torri operate to effect a thorough intermixing of air from overhead, upper and lower stratas, whereby a more uniform temperature is established at all stratas.

Stated in another way, a significant advantage of the present invention is that it provides a simple and inexpensive method of reclaiming heat that would otherwise be lost due to the accumulation of light density heated air along high ceilinged areas of an industrial facility. By establishing a primary air flow torus at a lower level which induces the formation of a secondary air flow torus at a higher level, air from all strata of a high-ceilinged room can be effectively and efficiently commingled and circulated to promote temperature equalization at all levels. By retrieving lost heat from overhead strata, heating costs can be substantially reduced. By efficiently commingling and circulating air throughout the industrial facility, pockets of uncomfortably hot and cold air are dissipated and working conditions are substantially improved.

In the preferred embodiment, the apparatus is portable and its upstanding structure is provided by a stacked array of lower, intermediate, and upper modules or sections. The modules or sections are releasably connected one atop another and form an upstanding structure of substantially right parallelepiped configuration. The lower and upper modules have sidewalls that are perforated around substantially their entire perimeters to define the described lower and upper openings. Intermediate modules have solid sidewalls, house the blower assembly, and may also house a heater assembly.

If a heater assembly is provided in an intermediate section of the apparatus, it is preferably an electrical heater assembly which can be energized when required to supplementally heat the circulating air. A plurality of resistance heating elements are used and are selectively energized as needed. These heating elements can, in the event of failure of permanently installed heaters, be used to provide a primary source of heat for the area surrounding the apparatus.

The modules each preferably have a welded angle iron framework which defines upper and lower perimetrically extending mounting flanges. Aligned holes drilled in the flanges permit the modules to be bolted together and disassembled if need be to move the apparatus through a small door opening.

While a top cover plate is usually employed to close the open end of the upper module, a vent conduit can be provided which opens through the top cover for connection to a roof ventilator. A butterfly valve located in the vent conduit is used to proportion the amounts of air which are exhausted through the ventilator and recirculated to the environment of the apparatus. The vent conduit has particular use in summer months to promote ventilation and can be used to effectively exhaust fumes.

In accordance with other aspects of the present invention, methods of ductlessly circulating and selectively supplementally heating large volumes of air in industrial facilities include the steps of operating the described apparatus to establish a lower, substantially toroidal air flow circulation beside the apparatus which, in turn, induces the establishment of an upper, substantially toroidal air flow circulation above the apparatus. These methods promote an efficient, thorough intermixing and circulation of air throughout the facility.

It is one object of the present invention to provide a novel and improved methods and apparatus for circulating air in industrial facilities and the like.

It is another object to provide novel and improved methods and apparatus for supplementally heating air circulated in industrial facilities and the like.

It is a further object to provide novel and improved methods and apparatus for handling large volumes of air quietly and efficiently in industrial facilities and the like.

Still another object is to provide a novel and improved air handling apparatus which is sufficiently lightweight and easy to assembly and disassembly to permit its being moved as required to keep pace with moving centers of activity in industrial facilities and the like.

Other objects and a fuller understanding of the invention may be had by referring to the following description and claims taken in conjunction with the accompanying drawings.

DESCRIPTION OF THE PREFERRED EMBODIMENT

Figure 1:
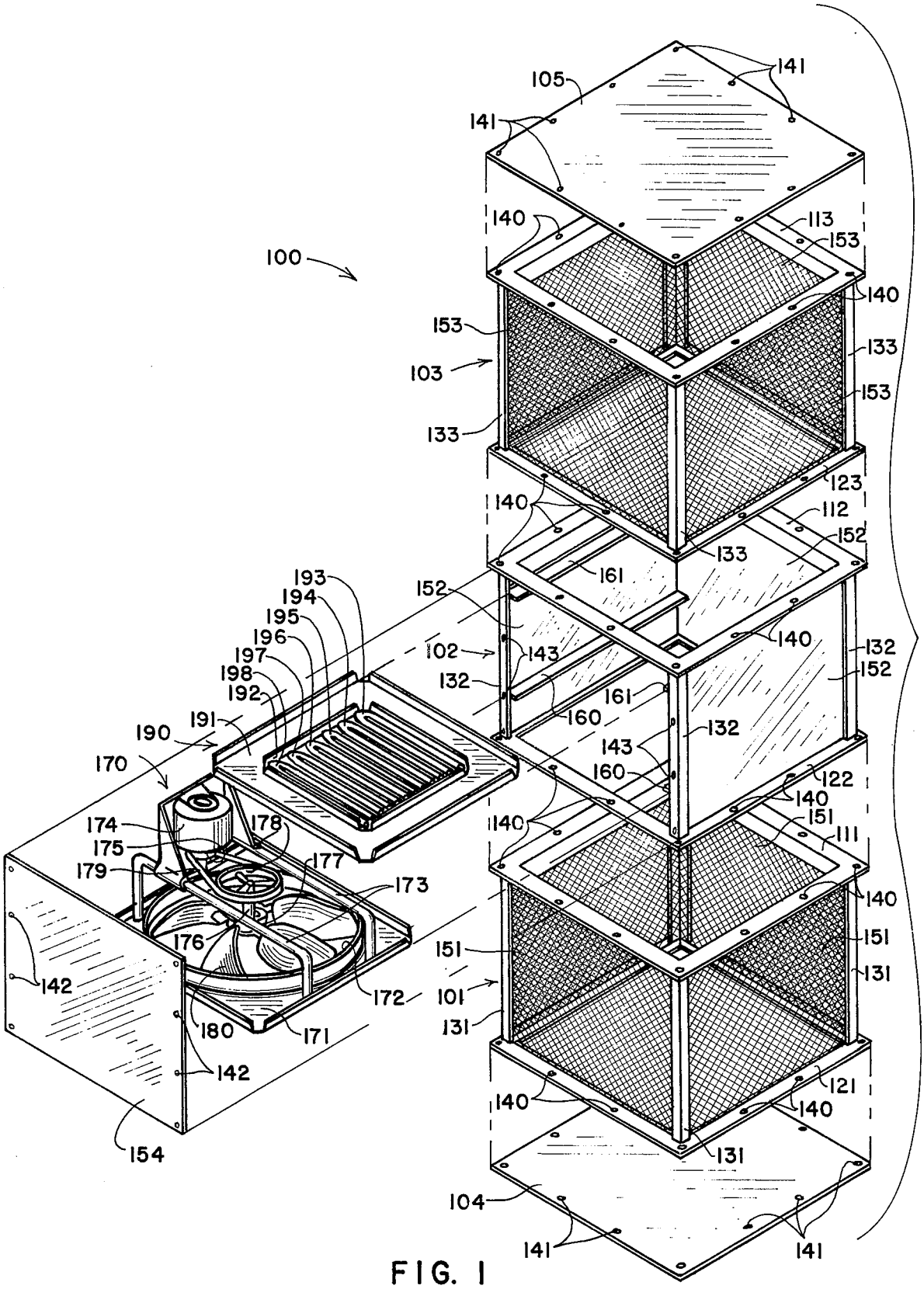
FIG. 1 is an exploded perspective view of an apparatus embodying certain aspects of the present invention.

Referring to FIG. 1, an apparatus embodying the one practice of the present invention is indicated generally by the numeral 100. The apparatus 100 includes lower, intermediate and upper sections or modules 101, 102, 103 supported one atop the other. Each of the sections 101, 102, 103 is of substantially right parallelepiped construction with corners and edges defined by a welded framework of angle iron. A bottom plate 104 may be provided to cover the open bottom end of the lower section 101, or the apparatus 100 may simply be positioned on a floor with the floor closing the bottom end of the lower section. A top plate 105 closes the open top end of the upper section 103.

The welded angle iron frameworks for the sections 101, 102, 103 are identical and include upper rectangular frames 111, 112, 113, lower rectangular frames 121, 122, 123, and interconnecting upstanding corner members 131, 132, 133. Horizontally extending flanges of the upper and lower frames 111, 112, 113, 121, 122, 123 are drilled at spaced locations to provide aligned bolt holes 140. The bottom and top plates 104, 105 are also drilled at spaced locations to provide aligned bolt holes 141. Bolts (not shown) are inserted in the bolt holes 140, 141 and are secured by lock washers and nuts (not shown) to hold the sections 101, 102, 103 together and to secure the bottom and top plates 104, 105 on the lower and upper sections 101, 103.

The lower and upper sections 101, 103 have four sidewalls 151, 153 formed from expanded metal screen material. The expanded metal sidewalls 151, 153 are welded to the frameworks of the lower and upper sections 101, 103 and provide inlets and outlets, respectively, for air to enter and discharge from the intermediate section 102.

The intermediate section 102 has three upstanding sidewalls 152 formed from sheet metal and welded to the framework of the intermediate section 102. A fourth side of the intermediate section is provided with a removable sidewall door positioned alongside the framework of the intermediate section 102 to close the open side of the intermediate section 102. Aligned bolt holes 142, 143 are provided in the door 154 and in the framework of the intermediate section 102. The framework holes 143 are threaded to receive bolts (not shown) that are slip-fitted through the door holes 142.

Lower and upper pairs of horizontally extending angle iron brackets 160,161 are welded inside the framework of the intermediate section 102. An electric blower assembly 170 is provided for positioning atop the lower brackets 160. An electric heater assembly 190 is provided for positioning atop the upper brackets 161.

The blower assembly 170 includes a base plate 171 of rectangular configuration which is adapted for insertion through the open side of the intermediate section 102 to a position where it rests atop and is supported by the lower brackets 160. A round hole 172 is formed centrally through the base plate 171. A pair of U-shaped tubular rails 173 are secured to opposite sides of the base plate 171 and extend in parallel spaced relationship over the hole 172.

An electric motor 174 is mounted near one end of the rails 173. A drive pulley 175 is carried on the drive shaft of the motor 174. A vertically extending shaft 176 is journaled by a bearing assembly 177. The bearing assembly 177 is mounted on the rails 173 at a location centrally above the hole 172. A pulley 178 is carried on the upper end region of the shaft 176. A drive belt 179 is reeved around the pulleys 175, 178 to drivingly interconnect the motor 174 and the shaft 176.

A fan 180 is supported on the lower end region of the shaft 176. The motor 174 is wired such that when it is supplied with electricity, it will rotate the fan 180 to draw air inwardly through the sidewalls of the lower section 101, blow air upwardly through the intermediate section 102, and discharge air through the sidewalls of the upper section 103.

The heater assembly 190 includes a base plate 191 of rectangular configuration which is adapted for insertion through the open side of the intermediate section 102 to a position where it rests atop and is supported by the upper brackets 161. A rectangular hole 192 is formed centrally through the base plate 191.

Six U-shaped electrical heater rods 193, 194, 195, 196, 197, 198 are supported in spaced relationship across the hole 192. The heater rods 193, 194, 195, 196, 197, 198 are of a commercially available type and preferably include resistance heating elements. In the preferred practice of the invention, the heater rods 193, 195, 197 are wired through suitable controls to permit their energization by connection to a three-phase electrical source independently of the heater rods 194, 196, 198. The heater rods 194, 196, 198 are wired to selectively permit their concurrent energization with the heater rods 193, 195, 197 by connection to the same three-phase electrical source. Suitable thermostatic and safety shut-down controls (not shown) of a conventional type are also provided to cycle the heater rods 193, 198 on and off and to prevent their becoming overheated in the event of a thermostatic control failure.

The heating rods 193–198 preferably each have a power input of about 5000 watts, giving the apparatus 100 a total heater power input of about 30,000 watts. This heating capacity is more than adequate to supplementally heat air in an industrial area of about 7000 to 10,000 square feet. In the event of a failure of conventional heating equipment, the apparatus 100 can be used as a primary source of heat. Air discharging from the apparatus 100 is preferably not heated in excess of about 125° F.

A significant feature of the apparatus 100 is its simple, lightweight, modular construction which permits the apparatus to be transported easily from place to place within an industrial facility. The modules or sections 101, 102, 103 preferably have dimensions of about 36 inches in height and 44 by 44 inches in length and width, with the fan 180 being about 36 inches in diameter. As such, the apparatus 100 has a capability for circulating large volumes of air in a gentle and quiet fashion that in no way disturbs the chores of nearly workers. Wheels can be added, as indicated by the numeral 230 in FIG. 5, to the lower section 101 to facilitate moving the apparatus 100 when areas of activity concentration change from room to room in an industrial facility.

An additional feature of the apparatus 100 is that it increases the efficiency of existing heating equipment by providing a thorough mixing and recirculation of air which inhibits the collection of stagnant pockets of heated air near high ceilings. A substantial fuel savings has been found to result in the operation of conventional heaters where the apparatus 100 has been used simply to better circulate the air heated by the conventional heaters.

Figure 2:
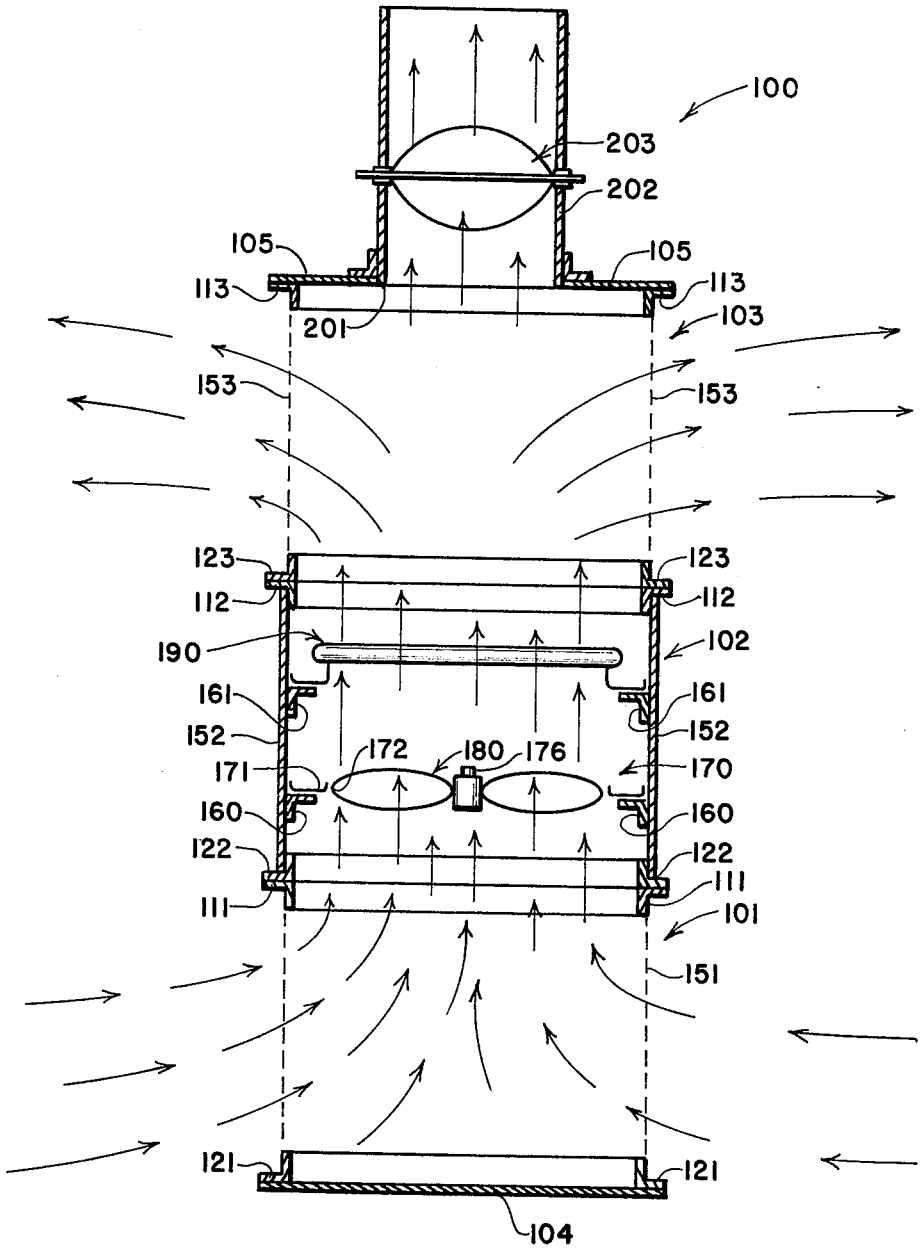
FIG. 2 is a schematic sectional view of an alternate apparatus embodiment.

The circulation paths followed by air in moving through the apparatus 100 is indicated by arrows in FIG. 2. A "stratified" circulation results with lower strata air being drawn substantially radially inwardly in a 2 to 3 foot thick lower blanket toward the apparatus 100. Air discharged from the apparatus tends to disperse substantially radially outwardly in a 2 to 3 foot thick upper strata blanket, and return, once it has cooled, and descended to the lower strata.

Figure 5:
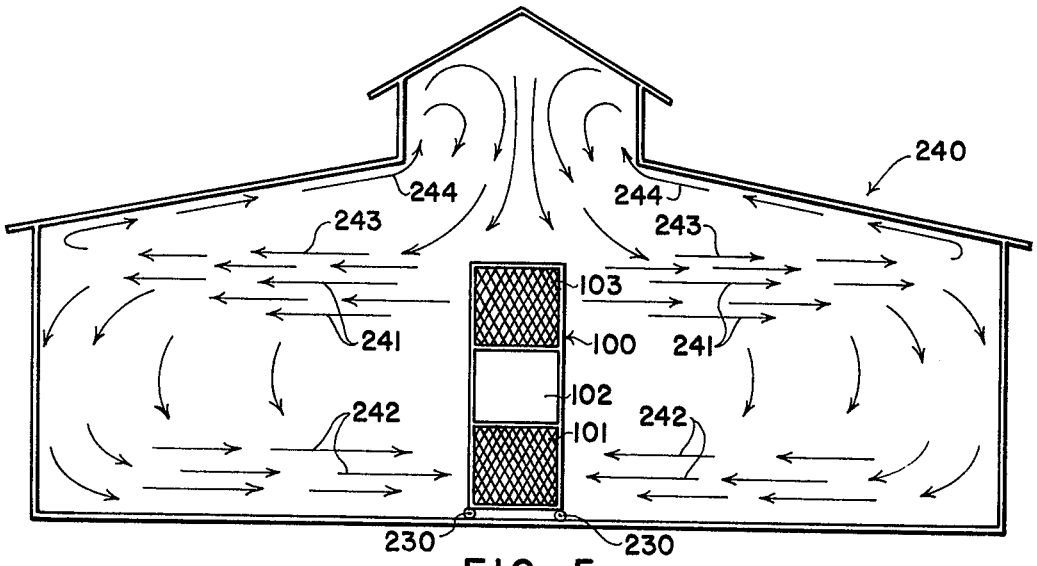
FIG. 5 is a schematic elevational view illustrating air flow circulations established in accordance with methods of the present invention.

Referring to FIG. 5, a room in industrial facility or the like is indicated generally by the numeral 240. The apparatus 100 is preferably positioned substantially centrally in the room 240. In operation, air discharging from the apparatus 100 tends to travel substantially radially outwardly from the upper section 103 toward the walls of the room 240 in an upper strata blanket, as indicated by arrows 241. At the same time, air is drawn from a lower strata substantially radially inwardly in a lower strata blanket toward the lower section 101, as indicated by arrows 242. The "primary" air circulation flow which results, when viewed in three dimensions, is of substantially toroidal or doughnut shape.

Air flowing in the upper blanket of the primary torus, as indicated by the arrows 241, has a lesser pressure than does static air above it. This phenomena is explained in Bernoulli's Theorem which states that the pressure of a flowing fluid is reduced as the speed of flow is increased. The reduced pressure of air in the upper strata blanket helps to induce the establishment of an overhead "secondary" air flow circulation, as will now be described.

Air flowing in the upper strata radially outwardly from the upper section 103 has its highest velocity, and hence its lowest pressure, adjacent the upper section 103. As air in the upper strata travels radially outwardly from the upper section 103 it disperses and diminishes in velocity, whereby its pressure gradually approaches that of ambient static air. The substantially reduced pressure of air near the upper section 103 causes overhead air to circulate downwardly from levels near the highest ceilinged part of the room 240 and toward the apparatus 100.

The overhead air which circulates downwardly commingles with air in the upper strata, and flows radially outwardly from the upper section 103 as indicated by arrows 243. The air drawn down from high ceilinged areas is replaced by other overhead air drawn into circulation as indicated by arrows 244. The overhead circulation which is induced in this manner has a configuration that is dependent on ceiling configuration and other factors, but can, for the sake of simplicity, be described as a "secondary" upper torus having an air flow direction which is opposite to that of the lower "primary" torus.

Referring to FIG. 2, the top plate 105 may be provided with a round centrally-located hole 201. A vent pipe 202 extends through the hole 201 and connects with the top plate 105. A conventional butterfly valve 203 is provided in the vent pipe 202 to control the proportion of air which discharges upwardly through the vent pipe 202 and outwardly through the sidewall screens 153. Where the vent pipe 202 is used, it is connected to a roof vent to permit the discharge of air to the exterior of a building. The vent pipe 202 is employed where the apparatus 100 is used to ventilate a stuffy building as during summer weather.

Figure 3:
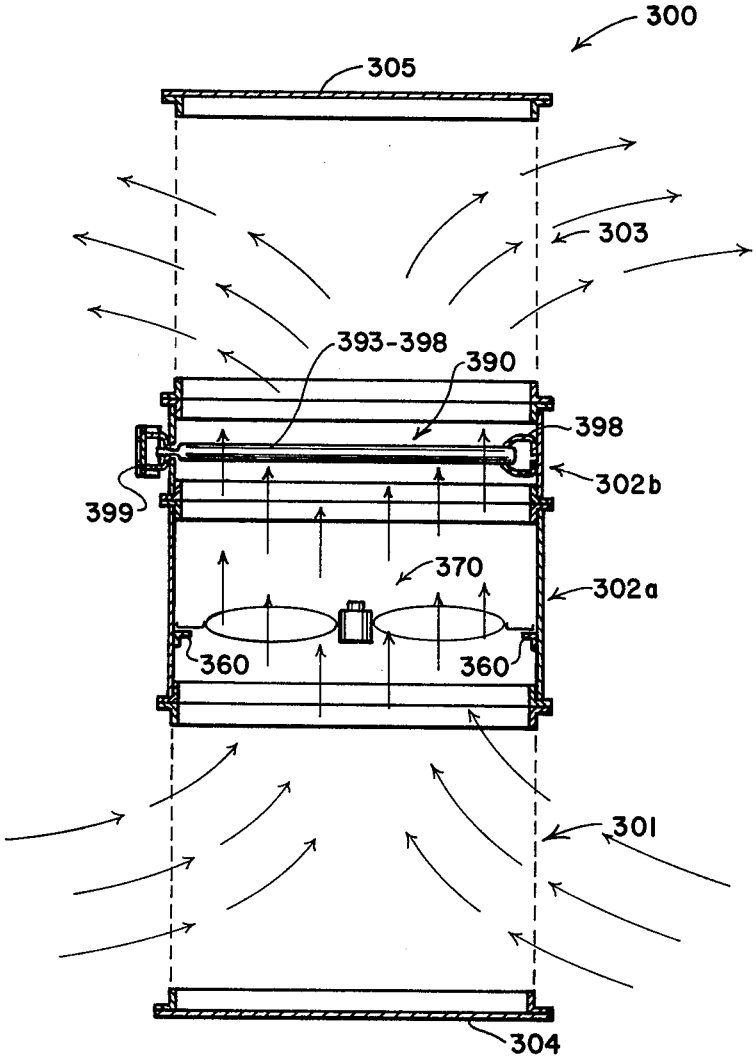
FIG. 3 is a schematic sectional view of the preferred apparatus embodiment.
Figure 4:
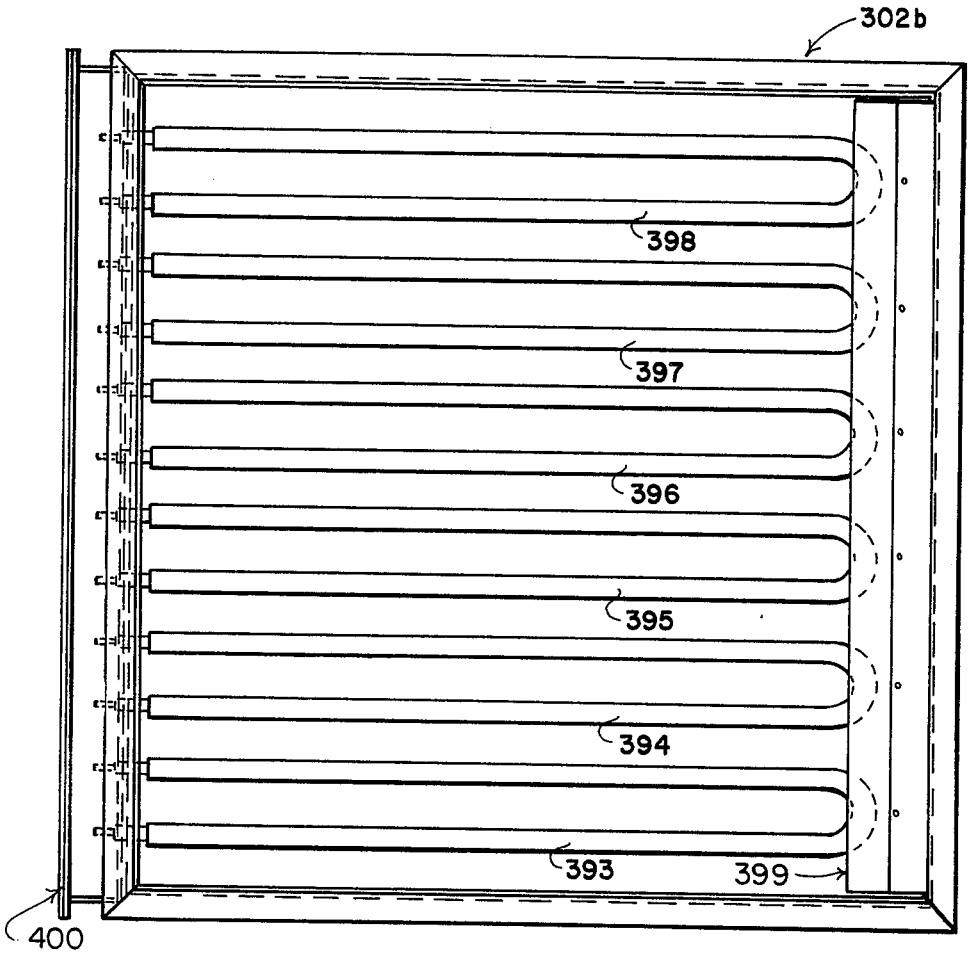
FIG. 4 is a top plan view of one of the modules of the apparatus of FIG. 3 as seen with the upper module removed.

Referring to FIGS. 3 and 4, a preferred apparatus embodiment is indicated by the numeral 300. The apparatus 300 includes a lower section or module 301, intermediate sections or modules 302*a*, 302*b*, and an upper section or module 303. The sections 301, 302*a*, 302*b*, 303 are supported one atop the other. Each of the sections 301, 302*a*, 302*b*, 303 is of substantially right parallelepiped construction with corners and edges defined by a welded angle iron framework. A bottom plate 304 may be provided to cover the open bottom end of the lower section 301, or the apparatus 300 may simply be positioned on a floor with the floor closing the bottom of the lower section. A top plate 305 closes the open top end of the upper section 303.

The lower and upper sections 301, 303 are identical to the described sections 101, 103. The intermediate sections 302*a*, 302*b* have a combined height which equals that of the described intermediate section 102. The lower intermediate section 302*a* houses a blower assembly 370 while the upper intermediate section 302*b* houses a heater assembly 390.

Referring to FIG. 3, the blower assembly 370 is identical to the blower assembly 170 and is supported on a pair of angle iron brackets 360 that are identical to the brackets 160.

Referring to FIGS. 3 and 4, the heater assembly 390 includes six U-shaped heater rods 393, 394, 395, 396, 397, 398. A bracket assembly 399 supports the U-shaped ends of the rods 393–398. Opposite ends of the rods 393–398 are received in an electrical conduit assembly 400 for connection to suitable electrical controls, not shown. The heating rods 393–398 operate in the manner of the rods 193–198 to selectively provide supplemental heat to air moving upwardly through the apparatus 300.

One of the apparatuses 100 or 300 having a height of about 9 feet and a blower capacity for circulating about 11,000 cubic feet of air per minute will adequately serve a room of 7000 to 10,000 square feet having ceilings of average industrial height. If the floor area is substantially larger or if the ceilings are much higher than normal, a plurality of the apparatuses can be used at spaced, central locations in the room. The apparatuses should have a capability for recirculating air from 2 to 4 times per hour in order to adequately promote temperature uniformity throughout the room.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and the scope of the invention as hereinafter claimed. It is intended that the patent shall cover, by suitable expression in the appended claims, whatever features of patentable novelty exist in the invention disclosed.

What is claimed is:

1. An apparatus positionable at a central location within a heated industrial building and the like to promote improved circulation of heated air within the walls of the building and thereby improve the efficiency of operation of existing heater units, comprising:

(a) an upstanding structure of substantially right parallelepiped configuration including an assembly of lower and upper modules with at least one intermediate module arranged one atop the other and releasably secured together to define a vertical chamber extending through the assembled modules;

(b) each of said lower and upper modules having planar, multi-perforated perimetral faces over substantially the entire lateral surface area thereof to define air inlets and air outlets, respectively, for said apparatus;

(c) said air inlets and said air outlets each being of a height of from about 2 to 3 feet to draw in and discharge air in stratified layers and at a velocity sufficient to establish a generally toroidal flow of air toward the walls of said building;

(d) said toroidal flow being sufficient to establish a counter toroidal flow in the air above said apparatus so as to recirculate heated air which accumulates adjacent the ceiling of said building;

(e) each of said at least one intermediate module having sidewalls imperforate to air to inhibit the passage of air therethrough;

(f) a blower assembly housed entirely within said at least one intermediate module and including a fan for drawing ambient air through said air inlet, ducting said air upwardly through the chamber and discharging said air through said air outlet at a velocity sufficient to establish a toroidal flow toward the walls of said building;

(g) and said upper and lower modules being devoid of any encumbrance to air flow therethrough.

2. The apparatus of claim 1 additionally including an electrical heater assembly housed by an intermediate module for supplementally heating air discharged from the blower assembly.

3. The apparatus of claim 1 wherein said closure means includes a cover closing the top end of the upstanding structure, a vent conduit opening through the cover and communicating with the chamber, and valve means for regulating the flow of air through the vent conduit.

* * * * *